US005746830A

United States Patent [19]

Burton et al.

[11] Patent Number: 5,746,830

[45] Date of Patent: May 5, 1998

[54] PNEUMATIC GRANULE BLENDER FOR ASPHALT SHINGLES

[75] Inventors: Charles A. Burton, Columbus; Douglas E. Boyd, Dublin; Thomas D. Haubert, Columbus; James S. Belt, Utica, all of Ohio

[73] Assignee: Owens-Corning Fiberglas Technology, Inc., Summit, Ill.

[21] Appl. No.: 682,417

[22] Filed: Jul. 17, 1996

Related U.S. Application Data

[63] Continuation of Ser. No. 144,374, Nov. 2, 1993, abandoned.

[51] Int. Cl.[6] ..... B05C 19/04; B05C 19/06

[52] U.S. Cl. ..... 118/308; 239/119; 239/99; 141/65; 427/186; 222/399

[58] Field of Search ..... 118/308, 324, 118/600, 24, DIG. 4; 239/119, 99, 654; 222/399, 460, 462, 185.1; 141/65, 10; 427/186, 188

[56] References Cited

U.S. PATENT DOCUMENTS

| | | |
|---|---|---|
| 1,154,334 | 9/1915 | Overbury . |
| 1,214,658 | 2/1917 | Dun Lany . |
| 1,264,831 | 4/1918 | McKay . |
| 1,376,092 | 4/1921 | Heppes . |
| 1,379,368 | 5/1921 | Speer . |
| 1,456,224 | 5/1923 | Currier . |
| 1,472,227 | 10/1923 | Overbury . |
| 1,774,988 | 9/1930 | Maclean . |
| 1,791,571 | 2/1931 | Overbury . |
| 1,916,095 | 6/1933 | Cumfer . |
| 2,058,578 | 10/1936 | Eckert . |
| 2,111,761 | 3/1938 | Eckert . |
| 2,122,739 | 7/1938 | Dudleston . |
| 2,157,944 | 5/1939 | Walton . |
| 2,163,757 | 6/1939 | Maclean et al. . |
| 2,253,652 | 8/1941 | Ritter . |
| 2,302,183 | 11/1942 | Burns . |
| 2,359,029 | 9/1944 | Goldberg . |
| 2,430,534 | 11/1947 | Rodi . |
| 2,605,036 | 7/1952 | Cozzoli . |
| 2,661,303 | 12/1953 | Fasold et al. . |
| 2,728,685 | 12/1955 | Muench . |
| 2,851,401 | 9/1958 | Payne . |
| 2,905,569 | 9/1959 | Zitke . |
| 2,949,206 | 8/1960 | Figge . |
| 2,978,149 | 4/1961 | Rosen . |

(List continued on next page.)

FOREIGN PATENT DOCUMENTS

| | | |
|---|---|---|
| 107626 | 5/1984 | European Pat. Off. . |
| 125585 | 11/1984 | European Pat. Off. . |
| 224621 | 6/1987 | European Pat. Off. . |
| 2118072 | 10/1983 | United Kingdom . |
| 2158813 | 11/1985 | United Kingdom . |
| WO94/01222 | 1/1994 | WIPO . |
| WO95/12457 | 5/1995 | WIPO . |
| WO95/12458 | 5/1995 | WIPO . |

OTHER PUBLICATIONS

Pgs. 1–7 of Chapter 1 "Fluidization Engineering," Second Edition, 1991, Kunii & Levenspiel.

Pgs. 68–74 of Chapter 3 "Fluidization Engineering", Second Edition, 1991, Kunii & Levenspiel.

Brown, R.L. et al., Principles of Powder Mechanics, International Series of Monographs in Chemical Engineering, Pergamon Press, vol. 10, pp. 186–193.

*Primary Examiner*—Steven P. Griffin

*Attorney, Agent, or Firm*—C. Michael Gegenheimer; Ted C. Gillespie

[57] ABSTRACT

The apparatus for applying granules to a coated asphalt sheet has a nozzle for holding an accumulation of granules, an opening at the bottom of the nozzle for discharging the granules onto the coated asphalt sheet, a buffer chamber positioned in communication with the accumulation of granules, and a vacuum source for reducing the pressure in the buffer chamber to stop the flow of granules through the opening.

16 Claims, 4 Drawing Sheets

U.S. PATENT DOCUMENTS

| | | | |
|---|---|---|---|
| 2,979,235 | 4/1961 | Greaves . | |
| 3,150,022 | 9/1964 | Vida . | |
| 3,231,453 | 1/1966 | Smith . | |
| 3,305,276 | 2/1967 | Weber . | |
| 3,506,111 | 4/1970 | Eppenberger . | |
| 3,586,069 | 6/1971 | Vest et al. . | |
| 3,661,189 | 5/1972 | Bowser et al. . | |
| 3,693,672 | 9/1972 | Hiland | 141/7 |
| 3,716,082 | 2/1973 | Green . | |
| 3,797,890 | 3/1974 | Walters | 302/3 |
| 3,837,540 | 9/1974 | Wagener . | |
| 3,858,628 | 1/1975 | Bendle | 141/46 |
| 3,884,401 | 5/1975 | Winkler | 222/544 |
| 3,886,021 | 5/1975 | Breckenfelder . | |
| 3,964,793 | 6/1976 | Volpeliere | 302/3 |
| 4,045,584 | 8/1977 | Jones et al. . | |
| 4,067,623 | 1/1978 | Klein et al. . | |
| 4,178,974 | 12/1979 | Levin . | |
| 4,212,331 | 7/1980 | Benatar | 141/67 |
| 4,295,445 | 10/1981 | Kopenhaver . | |
| 4,352,837 | 10/1982 | Kopenhaver . | |
| 4,427,040 | 1/1984 | Taylor . | |
| 4,478,869 | 10/1984 | Brady et al. . | |
| 4,516,702 | 5/1985 | Schmidt . | |
| 4,550,755 | 11/1985 | Vredenburg, Sr. . | |
| 4,573,504 | 3/1986 | Rosenstrom | 141/59 |
| 4,583,486 | 4/1986 | Miller . | |
| 4,600,603 | 7/1986 | Mulder | 118/308 |
| 4,614,213 | 9/1986 | Englin | 141/59 |
| 4,647,471 | 3/1987 | Jenkins . | |
| 4,668,323 | 5/1987 | Lenards et al. . | |
| 4,688,610 | 8/1987 | Campbell | 141/83 |
| 4,738,287 | 4/1988 | Klinkel . | |
| 4,800,102 | 1/1989 | Takada . | |
| 4,851,248 | 7/1989 | Simelunas et al. . | |
| 4,872,969 | 10/1989 | Sechrist . | |
| 4,873,103 | 10/1989 | Cordera . | |
| 4,907,720 | 3/1990 | Henson et al. . | |
| 4,943,163 | 7/1990 | Steele | 366/106 |
| 4,955,270 | 9/1990 | Volk, Jr. | 73/861.71 |
| 4,974,646 | 12/1990 | Martin et al. | 141/67 |
| 4,976,296 | 12/1990 | Pope | 141/46 |
| 5,016,687 | 5/1991 | Kawamura . | |
| 5,098,557 | 3/1992 | Hirschler et al. | 209/29 |
| 5,109,893 | 5/1992 | Derby . | |
| 5,186,980 | 2/1993 | Koschitzky . | |
| 5,217,554 | 6/1993 | Stroppiana . | |
| 5,234,037 | 8/1993 | Derby . | |
| 5,248,524 | 9/1993 | Soderlund . | |
| 5,275,215 | 1/1994 | Derby . | |
| 5,283,080 | 2/1994 | Lamb et al. . | |
| 5,323,819 | 6/1994 | Shade . | |
| 5,347,785 | 9/1994 | Terrenzio et al. . | |
| 5,405,647 | 4/1995 | Grubka et al. . | |

PNEUMATIC GRANULE BLENDER FOR ASPHALT SHINGLES

This application is a continuation of application Ser. No. 08/144,374, filed Nov. 2, 1993 now abandoned.

TECHNICAL FIELD

This invention pertains to the handling of continuous strips of asphaltic material, such as asphaltic material suitable for use as roofing membranes and roofing shingles. In one of its more specific aspects, this invention relates to controlling the application of granules to asphaltic strip material.

BACKGROUND OF THE INVENTION

A common method for the manufacture of asphalt shingles is the production of a continuous strip of asphaltic shingle material followed by a shingle cutting operation which cuts the material into individual shingles. In the production of asphaltic strip material, either an organic felt or a glass fiber mat is passed through a coater containing liquid asphalt to form a tacky coated asphaltic strip. Subsequently, the hot asphaltic strip is passed beneath one or more granule applicators which apply the protective surface granules to portions of the asphaltic strip material. Typically, the granules are dispensed from a hopper at a rate which can be controlled by making manual adjustments on the hopper. In the manufacture of colored shingles, two types of granules are employed. Headlap granules are granules of relatively low cost for portions of the shingle which are to be covered up. Colored granules or prime granules are of relatively higher cost and are applied to the portion of the shingle which will be exposed on the roof.

To provide a color pattern of pleasing appearance the colored shingles are provided in different colors, usually in the form of a background color and a series of granule deposits of different colors or different shades of the background color. These highlighted series of deposits, referred to as blend drops, are typically made from a series of granule containers by means of feed rolls. The length and spacing of each mixture on the sheet is dependent on the speed of the feed roll, the relative speed of the sheet and the length of time during which the drop is made.

Not all of the granules applied to the hot, tacky, coated asphaltic strip adhere to the strip, and, typically, the strip material is turned around a slate drum to invert the strip and cause the non-adhered granules to drop off. These non-adhered granules, which are known as backfall granules, are usually collected in a backfall hopper. The backfall granules are discharged at a set rate from the backfall hopper onto the strip material.

One of the problems with typical granule application equipment is that the feeder rolls depend on mechanical movement (rotation) to index to the next position to enable another blend drop to fall onto the moving coated asphalt sheet. Usually the granules are discharged from a hopper onto a fluted roll from which, upon rotation, the granules are discharged onto the coated asphaltic sheet. The roll is ordinarily driven by a drive motor, the roll being positioned in the drive or non-drive position by means of a brake-clutch mechanism. This requirement for mechanical action has inherent limitations which prevent a very precise beginning and ending to the blend drop. Consequently, there is a limit to the sharpness of the blend drops on the shingle. As shingle manufacturing lines go up in speed the lack of sharpness is accentuated, and the distinction between the blend drop and the background color becomes fuzzy. The lack of sharpness puts a severe limitation on the kinds of designs and color contrasts which can be applied to the shingle.

Another cause of the impreciseness of typical granule depositing techniques is that the feeders depend on gravity exclusively, not only for directing the granules from the hopper to the moving coated asphalt sheet, but also for movement of the granules within the hopper itself. The use of gravity to move the granules within the hopper or discharge apparatus itself has granule feed rate limitations, and there is no easy way to control the rate of flow of the granules.

An improved means and method for depositing granules onto the moving coated asphalt sheet would eliminate the lack of preciseness inherent in the mechanical action of a fluted roll. Also, the ideal system would provide a means for enhancing gravitational forces in starting and stopping flow and would enable some means for controlling the flow rate of granules during deposition.

SUMMARY OF THE INVENTION

There is now been developed a shingle granule deposition device which solves the problems of accurate, relatively instantaneous control of the flow of the granules. The method and apparatus of this invention starts, stops and controls the flow rate of granules by providing pneumatic pressure changes in a buffer chamber positioned adjacent a pile or an accumulation of granules in a granule nozzle. The opening in the nozzle through which the granules flow is sized with respect to the size of the granules so that slight pressure variations in the buffer chamber will start, accelerate or stop the flow of granules through the nozzle opening.

According to this invention, there is provided apparatus for applying granules to a coated asphalt sheet comprising a nozzle for holding an accumulation of granules, an opening at the bottom of the nozzle for discharging the granules onto the coated asphalt sheet, a buffer chamber positioned in communication with the accumulation of granules, and vacuum means for reducing the pressure in the buffer chamber to stop the flow of granules through the opening.

In a specific embodiment of the invention, pressure means, such as a fan, is also supplied to increase the air pressure in the buffer chamber to initiate a flow of granules through the opening. In a particular embodiment of the invention the pressure means comprises a pressure fan and a valve positioned between the pressure fan and the buffer chamber.

In yet another embodiment of the invention the accumulation of granules in the nozzle is supplied by a hopper, and the ratio of the height of the granules in the hopper to the height of the granules in the nozzle is greater than 1:1. In a particular embodiment of the invention the ratio is greater than or equal to about 3:1.

In yet another embodiment of the invention the vacuum means comprises a vacuum fan and a valve connecting negative gauge pressure air from the vacuum fan to the buffer chamber.

In a preferred embodiment of the invention the opening is a slot. Most preferably, the slot, nozzle and buffer chamber are arranged transverse to the machine direction of the moving coated asphalt sheet, and a source of both pressurized air and negative gauge pressure air is connected to each end of the buffer chamber.

In a particular embodiment of the invention the width of the slot is within the range of from about 0.06 to about 1.25 inches (about 0.15 to about 3.2 cm). Preferably, the width of the slot is within the range of from about 0.25 to about 0.75 inches (about 0.64 to about 1.9 cm).

In yet another embodiment of the invention flexible members are connected to the slot to help stop the flow of granules through the slot.

In a preferred embodiment of the invention the ratio of the width of the slot to the width of the surface of the accumulation of granules in the nozzle is greater than about 1:4.

According to this invention there is also provided a method of applying granules to a coated asphalt sheet comprising accumulating granules in a nozzle having an opening at the bottom for discharging the granules onto the coated asphalt sheet, and changing the air pressure in a buffer chamber positioned in communication with the accumulation of granules to control the flow of granules through the opening.

In a particular embodiment of the invention the step of changing the air pressure comprises reducing the pressure in the buffer chamber to stop the flow of granules through the opening. The air pressure in the buffer chamber is preferably decreased to a pressure within the range of about −5 to about −10 inches of water gauge pressure (about −9.3 to about −37.3 mm Hg) to stop the flow of granules through the opening.

In yet another embodiment of the invention the step of changing the air pressure comprises increasing the air pressure in the buffer chamber to initiate a flow of granules through the opening, and reducing the pressure in the buffer chamber to stop the flow of granules through the opening.

In a specific embodiment of the invention, the flow rate of granules through the opening is changed to accommodate changes in the speed of the coated asphalt sheet.

In yet another embodiment of the invention, a control means, operatively connected to the supply of pressurized air to the buffer chamber, is operated to vary the flow rate of granules through the opening to accommodate changes in the speed of the coated asphalt sheet.

In an additional embodiment of the invention, the size of the opening is changed to vary the flow rate of granules through the opening to accommodate changes in the speed of the coated asphalt sheet.

DETAILED DESCRIPTION OF THE INVENTION

Figure 1:
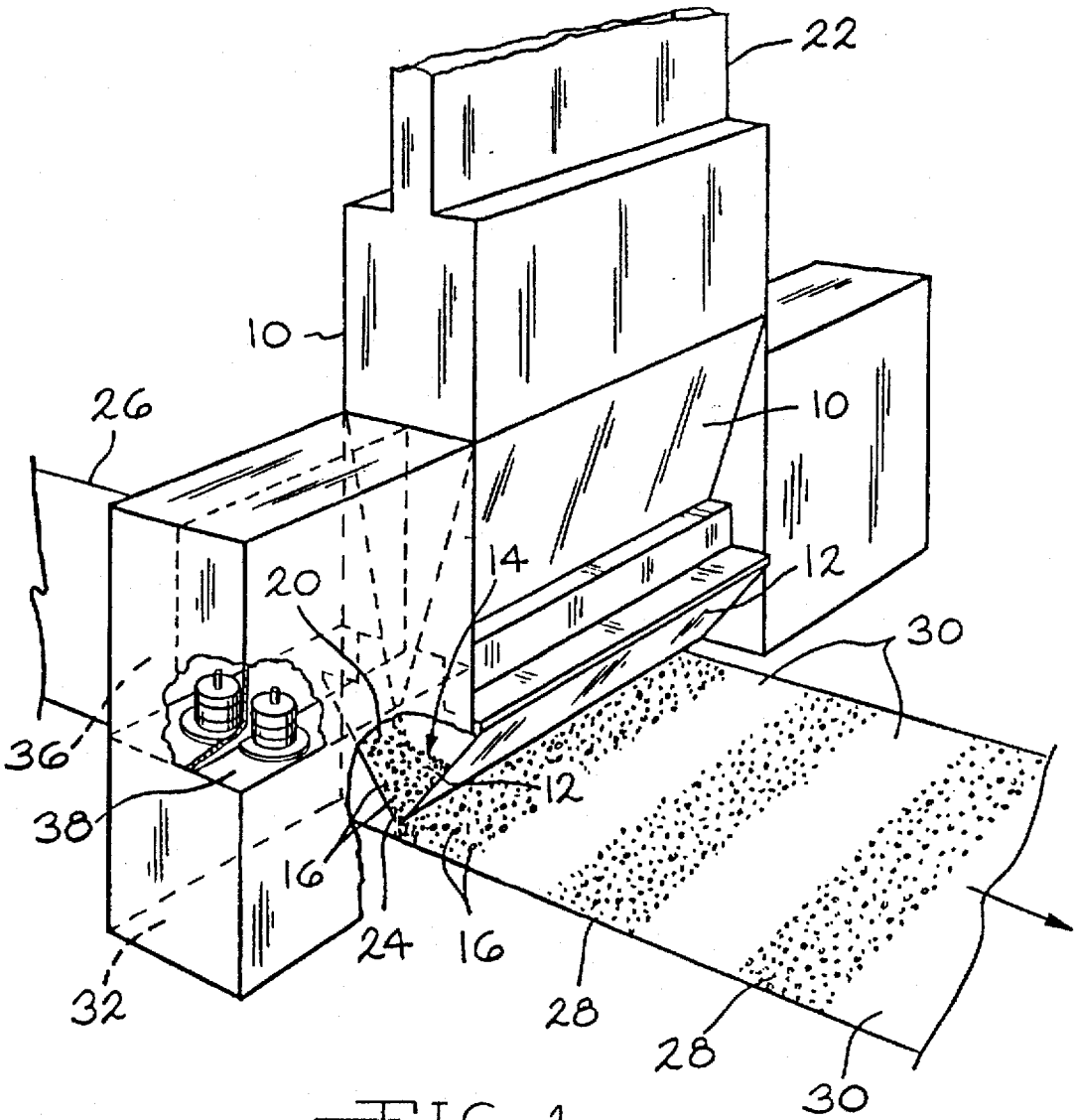
FIG. 1 is a schematic view in perspective of apparatus for dispensing granules according to the principles of the invention.
Figure 2:
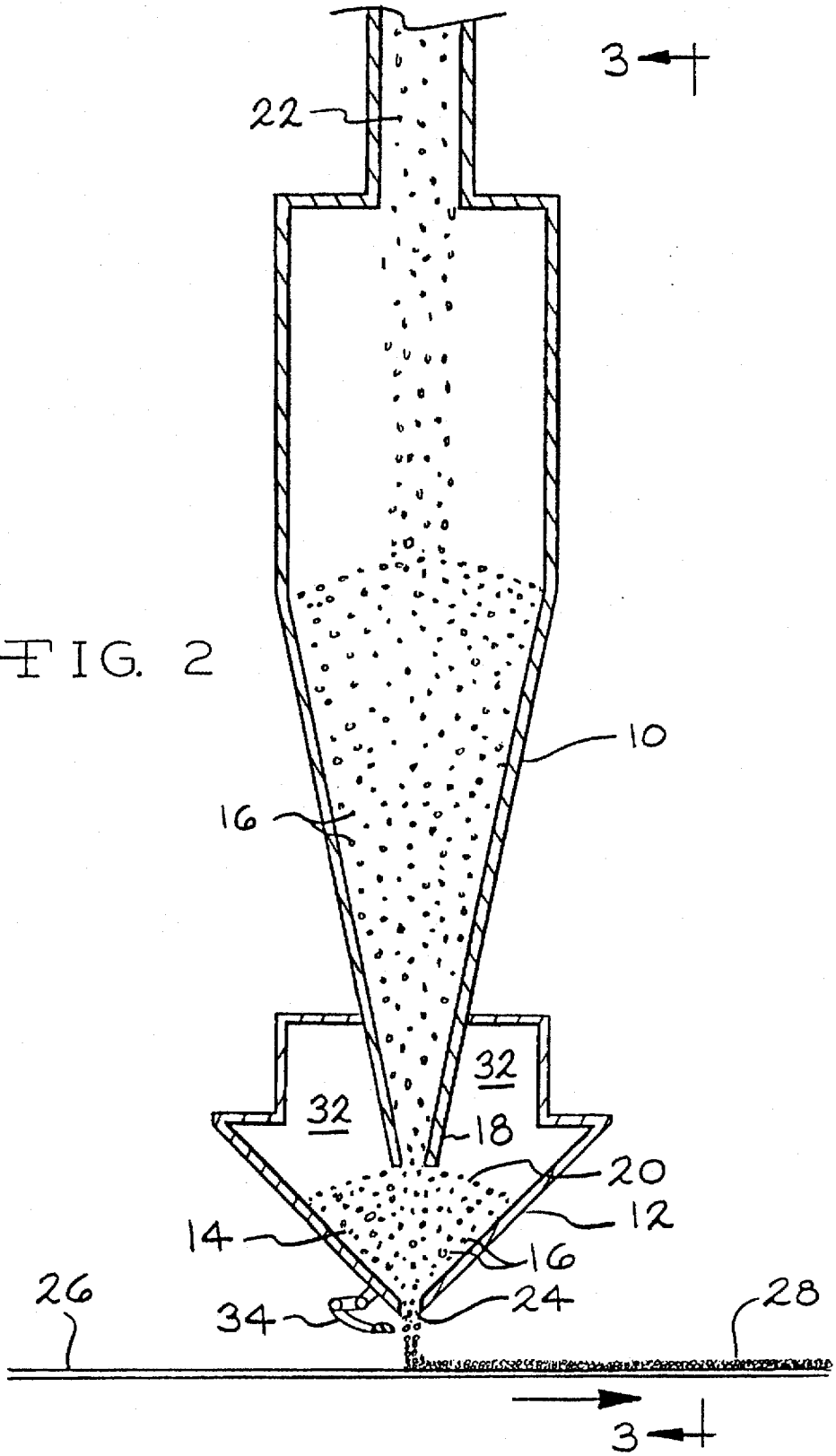
FIG. 2 is a schematic view in elevation of a cross section of the granule dispensing apparatus of FIG. 1.

As shown in FIGS. 1 and 2, the granule dispensing apparatus of the invention is generally comprised of hopper 10 and nozzle 12. The hopper can be any suitable means for supplying granules to the nozzle to form a pile or accumulation 14 of granules 16. The exit or throat 18 of the hopper narrows down to be considerably smaller in cross-sectional area than surface area 20 of the accumulation of granules.

Granules can be fed to the hopper by any suitable means, such as granule feeder 22, many designs for which are well known in the art. When the granules exit the nozzle they exit through an opening, such as slot 24 and are deposited on moving coated asphalt sheet 26. The granules are deposited onto the sheet in an intermittent manner to form a series of prime granule application areas or blend drops 28 which are separated by a series of background color areas, such as background color areas 30. Usually the background color granules are dropped onto the coated asphalt sheet after the blend drops are deposited, as is well known in the art.

As shown more clearly in FIG. 2, there is an open area, buffer chamber 32, positioned above the surface of the accumulation of granules in the nozzle. It is changes in the pressure of the buffer chamber which affect the flow of granules through the slot. It is to be understood that the buffer chamber is positioned adjacent the accumulation of granules in the nozzle. It need not necessarily be positioned above the granules. Also, a screen or perforated plate can be positioned at the surface of the accumulation of granules to separate the buffer chamber from the accumulation of granules.

During the start up of the granule application process, it may be necessary to close off the slot in the nozzle to provide sufficient back pressure to enable the granules to be stopped from flowing through the nozzle. Accordingly, a means, such as start-up plug 34, is provided to temporarily plug the slot during initiation of the process.

Figure 3:
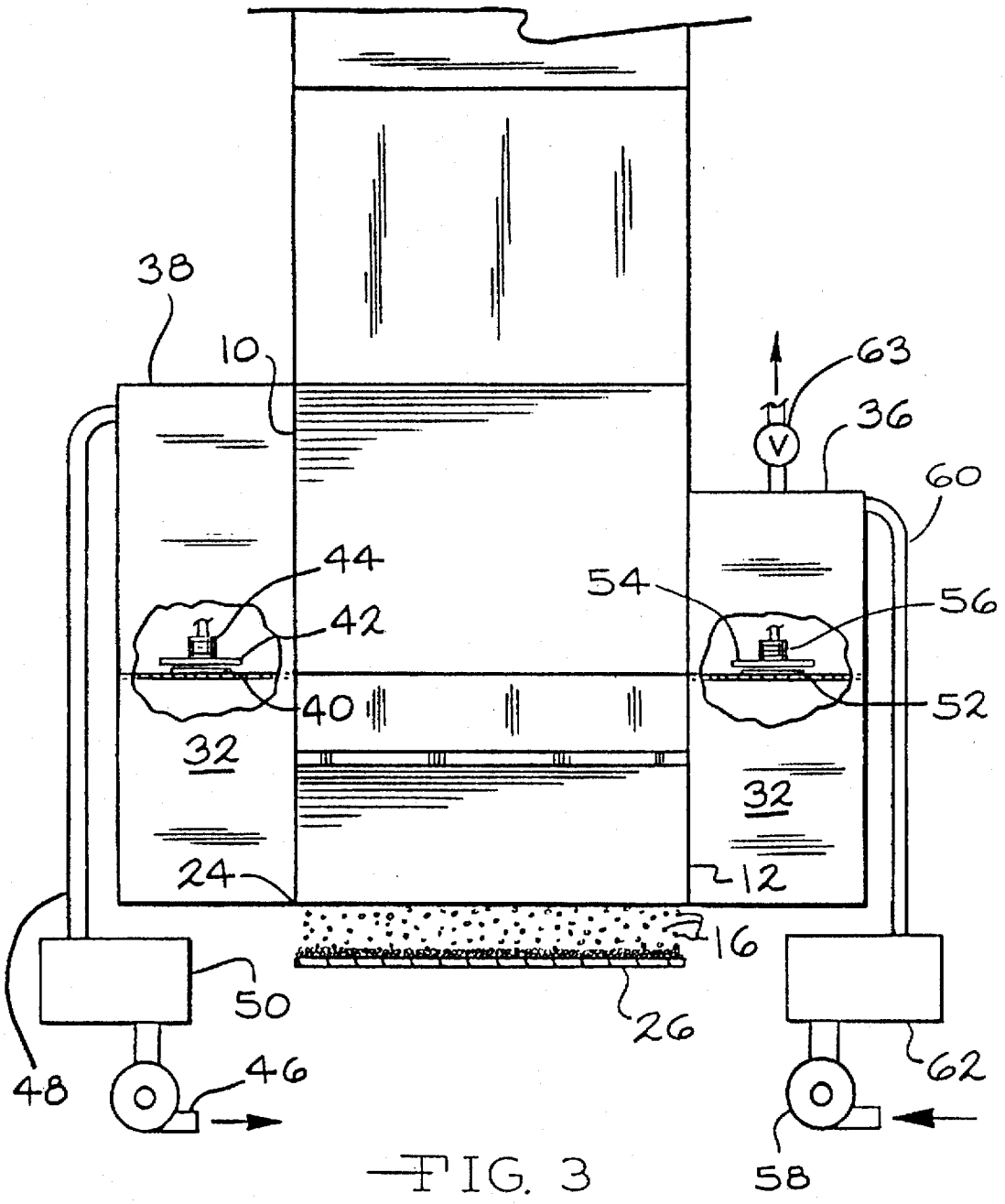
FIG. 3 is a schematic view in elevation of the granule dispensing apparatus of FIG. 2 taken along lines 3—3.

As shown in FIG. 3, the buffer chamber can be adapted to extend beyond either end of the nozzle, so that the buffer chamber is in communication with the top surface of the accumulation of granules in the nozzle. Positioned in communication with the buffer chamber are two other chambers which affect the pressure within the buffer chamber. These are pressure chamber 36 and vacuum chamber 38. The vacuum chamber is in communication with the buffer chamber through any suitable means, such as vacuum opening 40.

The flow of air from the buffer chamber to the vacuum chamber can be controlled by any suitable device, such as by vacuum plate 42 operated by vacuum solenoid 44. Any means, such as vacuum fan 46, can be put in communication with the vacuum chamber in order to produce a negative gauge pressure in the vacuum chamber. A vacuum fan is not the only possibility for creating the negative pressure within the vacuum chamber. Other devices include the use of a venturi or a pump.

The vacuum fan is operatively connected to the vacuum chamber by any suitable conduit, such as vacuum piping 48. Further, an accumulator, such as vacuum accumulator 50, can be used to dampen surges in demand and supply of the negative gauge pressure air. It can be seen that the opening and closing of the vacuum plate against the vacuum opening by action of the vacuum solenoid will affect the communication between the negative gauge pressure vacuum chamber and the buffer chamber. The application of negative gauge pressure to the buffer chamber will create a sufficient pressure drop over the accumulation of granules to stop the flow of granules through the slot.

When a negative pressure is applied to the vacuum chamber and through the vacuum opening to the buffer chamber, there is produced an upward flow of air through the slot and through the granules that have accumulated in the nozzle. The upward flow of air provides an upwardly oriented drag force on the granules in contrast to the downward pull of gravity on the granules. If the proper amount of negative pressure is applied to the buffer chamber, the drag force from the upward flow of air through the slot will balance the pull of gravity on the granules, and the granules will be held in place rather than continue falling down through the slot. The granules are held in place by the upward flow of air.

It should be understood that if the velocity of the air flow through the slot exceeds a critical level, then the granules would become fluidized, and begin to move as if they were caught in a fluid medium. Fluidization of the granules means that the granules are not held in place, but are supported with sufficient drag force of upwardly moving air that they are free to vibrate or move laterally relative to each other. The fluidization of the granules within the nozzle would create churning, mixing and various air flow paths which would contain some entrained granules. If the air flow is of sufficient velocity to cause fluidization of the granules, some of the granules would fall through the nozzle. Therefore, the amount of upward air flow through the nozzle must be carefully balanced so that the drag force exceeds the weight of the granules to prevent the granules from falling without causing fluidization of the granules.

Another problem of fluidization can occur if upward air velocity at the surface of the accumulation of granules creates drag force sufficient to cause some of the granules to become airborne. Airborne granules can foul the air handling system.

In a manner similar to the equipment shown on the vacuum side, the pressure chamber is in communication with the buffer chamber by means of pressure opening 52, and this can be controlled with any suitable device, such as pressure plate 54 operated by pressure solenoid 56. The pressure in the pressure chamber can be supplied by any suitable means, such as pressure fan 58 connected via pressure conduit 60, and employing pressure accumulator 62. It is to be understood that any number of mechanisms can be used to supply pressure to the pressure chamber, such as pumps, turbines, or bellows. It can be appreciated that the pressure plate acts as a valve between the pressure fan and the buffer chamber. Likewise, the vacuum plate acts as a valve to control the process of reducing the pressure in the buffer chamber used to stop the flow of granules through the slot. Another means for controlling the pressure in the pressure chamber is by using pressure relief valve 63.

In operation it has been found preferable to have sufficient height of the hopper relative to the height of the accumulation of granules in the nozzle so that pressure changes in the buffer chamber are communicated primarily to the granules and the accumulation of granules in the nozzle, rather than to the granules in the hopper. Preferably, the ratio of the height of the granules in the hopper to the height of the granules in the nozzle is greater than 1:1. Most preferably, the ratio is greater than or equal to about 3:1. If the ratio were lower than about 1:1 negative pressure in the buffer chamber would have the effect of drawing air through the granules in the hopper rather than through the granules in the accumulation in the nozzle. This would mean that the application of negative pressure in the buffer chamber would be ineffective in stopping the flow of granules passing through the slot.

As shown in FIG. 3, there is a source of pressurized air at one end of the apparatus, and a source of negative gauge pressure air connected to the other end of the buffer chamber. Where shingles of sufficient width are being produced; such as on a 3-wide machine or a 4-wide machine, it is preferable to have a source of both pressurized air and negative gauge pressure air connected to each end of the buffer chamber. This would reduce the possibility of a time delay in having the effect of a change in air pressure cross the width of the shingle manufacturing machine.

The size of the width of the slot depends in part upon the size of the granules used. For granules sized as 3M No. 11 grade roofing granules, the preferred slot has a size within the range of from about 0.06 to about 1.25 inches (about 0.15 to about 3.2 cm). Most preferably, the width of the slot is within the range of from about 0.25 to about 0.75 inches (about 0.64 to about 1.9 cm).

Figure 4:
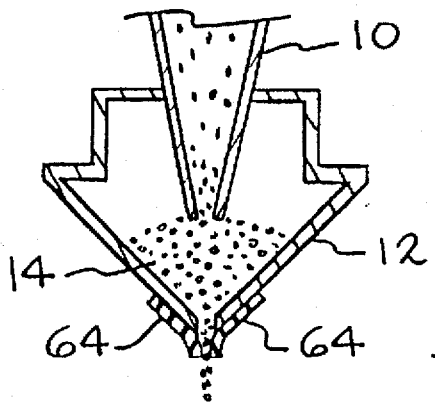
FIG. 4 is a schematic cross-sectional view in elevation illustrating the use of flexible flaps on the nozzle of the invention.

In order to most completely close off the slot when the granules are supposed to be stopped, it is preferable to use flexible members, such as thin stainless steel flaps 64 to help stop the flow of granules through the slot, as shown in FIG. 4. The flexible members can be of any suitable type, sufficient to allow the flow of granules during the time when the granules are supposed to be flowing.

Figure 5:
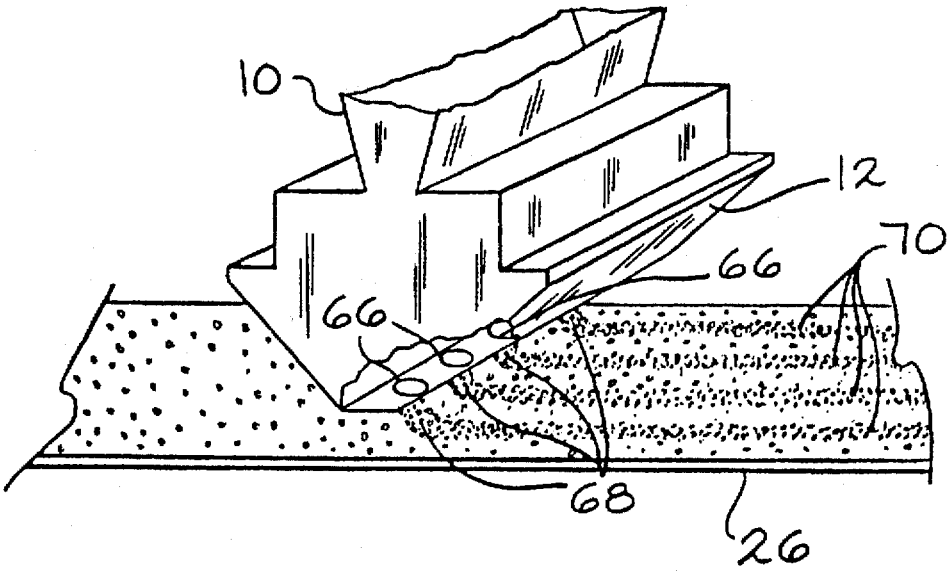
FIG. 5 is a schematic view in perspective illustrating an embodiment of the invention using a series of orifices rather than a slot in the dispensing nozzle.

It should be understood that the shape of the opening for discharging the granules need not be a slot. As shown in FIG. 5, the openings can be of different shapes, such as round or oval openings 66. As can be appreciated, a series of such oval openings would create a series of granule streams, such as granule streams 68. These granule streams could be used to produce particularly desired patterns of discreet granules, such as discreet granule patterns 70.

It has been found that the surface area of the accumulation of granules has a critical relationship with the width of the slot. This is because if the area of the surface of accumulation of granules is too small, the negative pressure will create a fluidized bed situation in which the granules are actually floating on the air, and this would interrupt the smooth processing of the apparatus. Preferably the ratio of the width of the slot to the width of the surface of accumulation of granules in the nozzle is greater than about 1:4.

It will be evident from the foregoing that various modifications can be made to this invention. Such modifications, however, are considered as being within the scope of the invention.

INDUSTRIAL APPLICABILITY

This invention will be found to be useful in the production of granule coated discreet roofing shingles suitable for use in residential and commercial roofing applications.

We claim:

1. Apparatus for applying granules to a coated asphalt sheet comprising;

a nozzle having an upper region for holding an accumulation of granules having a top surface and an opening at the bottom of the nozzle for discharging the granules onto the coated asphalt sheet, wherein the nozzle is wider at its upper region than at the nozzle opening;

a buffer chamber positioned above the nozzle in communication with the top surface of the accumulation of granules so that a negative pressure in the buffer chamber provides an upwardly oriented drag force on the granules in the accumulation of granules;

a hopper for supplying granules to the nozzle, the hopper having a throat for feeding granules to the accumulation of granules, wherein the hopper extends upwardly away from the buffer chamber and the nozzle, and is adapted to receive granules as a downwardly moving flow and to supply the granules to the accumulation of granules in the nozzle; and vacuum means connected to the buffer chamber for reducing the pressure in the buffer chamber to stop the flow of granules through the opening, wherein the vacuum means creates an upward flow of air through the granules at the opening, the upward flow of air being sufficient to prevent the granules from flowing down through the nozzle opening by gravity, but insufficient to create fluidization of the granules at the opening.

2. The apparatus of claim 1 comprising pressure means for increasing the air pressure in the buffer chamber to initiate a flow of granules through the opening.

3. The apparatus of claim 2 in which the pressure means comprises a pressure fan and a valve positioned between the pressure fan and the buffer chamber.

4. The apparatus of claim 2 in which the pressure means comprises a pressure fan and a valve between the pressure fan and the buffer chamber, and the vacuum means comprises a vacuum fan and a valve connecting negative gauge pressure air from the vacuum fan to the buffer chamber.

5. The apparatus of claim 1 in which a quantity of the granules is present in the hopper, and the ratio of the height of the granules in the hopper to the height of the granules in the nozzle is greater than 1:1.

6. The apparatus of claim 5 in which a quantity of the granules is present in the hopper, and the ratio of the height of the granules in the hopper to the height of the granules in the nozzle is greater than or equal to about 3:1.

7. The apparatus of claim 1 in the opening is a slot.

8. The apparatus of claim 7 in which the coated asphalt sheet is moving relative to the nozzle along a path, and the slot, nozzle and buffer chamber are arranged transverse to the coated asphalt sheet, and further comprising a source of positive gauge pressure air, and wherein said vacuum means comprises a source of negative gauge pressure air, said sources of positive gauge and negative gauge pressure air being connected to ends of the buffer chamber.

9. The apparatus of claim 7 in which the width of the slot is within the range of from about 0.25 to about 0.75 inches (about 0.64 to about 1.9 cm).

10. The apparatus of claim 7 comprising flexible members connected to the slot to help stop the flow of granules through the slot.

11. The apparatus of claim 7 in which the accumulation of granules has a top surface of granules within the nozzle, and the ratio of the width of the slot to the width of the top surface of the accumulation of granules in the nozzle is greater than about 1:4.

12.The apparatus of claim 1 in which the opening is a slot having a length and width, and the top surface of the accumulation of granules has a length and width, wherein the ratio of the width of the slot to the width of the top surface of the accumulation of granules in the nozzle is greater than about 1:4.

13. The apparatus of claim 12 comprising control means for varying air pressure in the buffer chamber, the control means being positioned between a pressure means and the buffer chamber as well as between the vacuum means and the buffer chamber to control the flow of granules through the slot to accommodate speed changes in the coated asphalt sheet.

14. The apparatus of claim 12 comprising flexible member connected to the nozzle at the slot to help stop the flow of granules through the slot.

15. The apparatus of claim 12 in which the vacuum means comprises a vacuum fan and a valve connecting negative gauge pressure air from the vacuum fan to the buffer chamber.

16. The apparatus of claim 1 wherein the hopper is connected to a source of ambient air so that when a ratio of the height of granules in the hopper to the height of granules in the nozzle is lower than about 1:1, negative pressure in the buffer chamber would have the effect of drawing air through the granules in the hopper rather than through the accumulation of granules in the nozzle.

* * * * *